US006509904B1

(12) United States Patent
Lam

(10) Patent No.: US 6,509,904 B1
(45) Date of Patent: Jan. 21, 2003

(54) METHOD AND DEVICE FOR ENHANCING THE RESOLUTION OF COLOR FLAT PANEL DISPLAYS AND CATHODE RAY TUBE DISPLAYS

(75) Inventor: Siu Lam, Woodcliff Lake, NJ (US)

(73) Assignee: Datascope Investment Corp., Montvale, NJ (US)

( * ) Notice: Subject to any disclaimer, the term of this patent is extended or adjusted under 35 U.S.C. 154(b) by 0 days.

(21) Appl. No.: 09/522,668

(22) Filed: Mar. 10, 2000

Related U.S. Application Data

(63) Continuation of application No. 08/969,406, filed on Nov. 7, 1997, now Pat. No. 6,104,375.

(51) Int. Cl.[7] ..... G09G 5/00
(52) U.S. Cl. ..... 345/613; 345/614
(58) Field of Search ..... 348/441; 345/88, 345/431, 604, 613, 614, 598

(56) References Cited

U.S. PATENT DOCUMENTS

| | | | | |
|---|---|---|---|---|
| 5,264,835 | A | * 11/1993 | Shaw et al. | 345/150 |
| 5,298,915 | A | * 3/1994 | Bassetti, Jr. | 345/149 |
| 5,341,153 | A | * 8/1994 | Benzschawel et al. | 345/152 |
| 5,543,819 | A | * 8/1996 | Farwell et al. | 345/150 |
| 5,821,913 | A | * 10/1998 | Mamiya | 345/88 |
| 5,841,418 | A | * 11/1998 | Bril et al. | 345/3 |
| 6,078,307 | A | * 6/2000 | Daly | 345/132 |
| 6,243,055 | B1 | * 6/2001 | Fergason | 345/32 |
| 6,307,566 | B1 | * 10/2001 | Hill et al. | 345/133 |

OTHER PUBLICATIONS www.microsoft.com/typography/cleartype/cleartypeq.htm Microsoft ClearType™ Overview (see enclosed printout).

www.microsoft.com/typography/cleartype/cleartypepr.htm Microsoft Research Announces Screen Display Breakthrough at COMDEX/Fall 98' (see enclosed printout).

http://research.microsoft.com/~jplatt/cleartype/ "Technical Overview of Clear Type Filtering" by John Platt of the Signal Processing Group of Microsoft Research, Jul.14, 2000. (see enclosed printout).

http://www.microsoft.com/reader/cleartype.asp ClearType® Display Technology (see enclosed printout).

http://www.microsoft.com/typography/default.asp (see enclosed printout).

* cited by examiner

*Primary Examiner*—Vijay Shankar
(74) *Attorney, Agent, or Firm*—Abraham Ronai

(57) ABSTRACT

A method and device for increasing the horizontal resolution of both a color flat panel display and a cathode ray tube (CRT) display. The method involves fine horizontal positioning of pixels according to information encoded in the color. Since pixel size is not changed, the display and processing bandwidth requirement is not increased. For the case of the color flat panel display, the fact that each pixel is constructed of a horizontal stripe of 3 primary color sub-pixels is utilized. Complex color information is spread across adjacent pixels to increase the apparent horizontal resolution by a factor of three. For the case of the CRT, a clock multiplier is used to multiply the video clock frequency by three. The apparent horizontal resolution of the CRT is increased by a factor of three by delaying pixels a varying multiple of this high clock speed. By encoding the fine repositioning information in the pixel color, the same display output can be post-processed respectively for the color flat panel and the CRT, allowing them to be driven and resolution enhanced simultaneously.

2 Claims, 9 Drawing Sheets

METHOD AND DEVICE FOR ENHANCING THE RESOLUTION OF COLOR FLAT PANEL DISPLAYS AND CATHODE RAY TUBE DISPLAYS

RELATED APPLICATIONS

The application is a continuation of and claims priority to application Ser. No. 08/969,406, filed on Nov. 7, 1997 now U.S. Pat. No. 6,104,375.

BACKGROUND OF THE INVENTION

1. Field of the Invention

The invention relates to a method and device for enhancing the resolution of color flat panel displays and cathode ray tube (CRT) displays. More particularly, the invention relates to a method and device for spreading complex color information across adjacent pixels of a display to increase the effective horizontal resolution.

2. Description of the Prior Art

Many techniques have been proposed to enhance the quality of digitized outputs of electronic display and hard-copy devices by reducing the effects of quantizations. The use of gray-scaling to smooth out jagged edges (commonly called anti-aliasing) is used in many applications. Unfortunately, the dot pitch of many common flat panel displays is not fine enough to allow effective use of gray-scale anti-aliasing. As a result, the-output of a common flat panel display employing an anti-aliasing technique looks more blurred than smoothed.

In patient monitors, some of the waveforms displayed can exhibit a high slew rate (a high slope), such as the ECG QRS complex. When these waveforms are displayed on a flat panel display, an objectionable stair stepping effect can be observed. The stair stepping effect is caused by a lack of horizontal display resolution. This lack of horizontal resolution has somewhat limited the acceptance of flat panel displays in high end patient monitoring equipment in which a higher quality waveform display is expected.

CRTs, unlike flat panels, do not have a fixed number of physical pixels. A CRT's resolution, however, is generally limited by the speed of the CRT display electronics. Therefore, the need exists for a post-processing resolution enhancing device capable of operating within the above mentioned physical design limitations inherent in the CRT and the color flat panel.

While the above mentioned smoothing method may be suitable for the particular purpose employed, or for general use, it would not be as suitable for the purposes of the present invention as disclosed hereafter.

SUMMARY OF THE INVENTION

Accordingly, it is an object of the invention to produce a post processing method and device for increasing the effective horizontal resolution of waveform displayed on a color flat panel display by a factor of three.

It is another object of the invention to produce a method and device for enhancing the resolution of a color flat panel display without blurring the display.

It is a further object of the invention to produce a method and device for enhancing the effective resolution of a color flat panel display which can be used in conjunction with traditional gray scale anti-aliasing techniques to further enhance the display.

It is yet a further object of the invention to produce a device for similarly enhancing the effective resolution of a waveform on a CRT display.

It is still yet a further object of the invention to produce a device for enhancing the effective horizontal resolution of a waveform on a CRT display which can be used in conjunction with traditional gray scale anti-aliasing techniques to further enhance the display.

It is still another object to produce a device capable of enhancing the effective horizontal resolution of a waveform on both a color flat panel and a CRT display being simultaneously driven.

It is still a further object of the invention to produce software capable of enhancing the horizontal resolution of a color flat panel display by a factor of three.

The invention is a method and device for increasing the horizontal resolution of both a color flat panel display and a cathode ray tube (CRT) display. The method involves fine horizontal positioning of pixels according to information encoded in the color. Since pixel size is not changed, the display and processing bandwidth requirement is not increased. For the case of the color flat panel display, the fact that each pixel is constructed of a horizontal stripe of 3 primary color sub-pixels is utilized. Complex color information is spread across adjacent pixels to increase the apparent horizontal resolution by a factor of three. For the case of the CRT, a clock multiplier is used to multiply the video clock frequency by three. The apparent horizontal resolution of the CRT is increased by a factor of three by delaying pixels a varying multiple of this high clock speed. By encoding the fine repositioning information in the pixel color, the same display output can be post-processed respectively for the color flat panel and the CRT, allowing them to be driven and resolution enhanced simultaneously.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
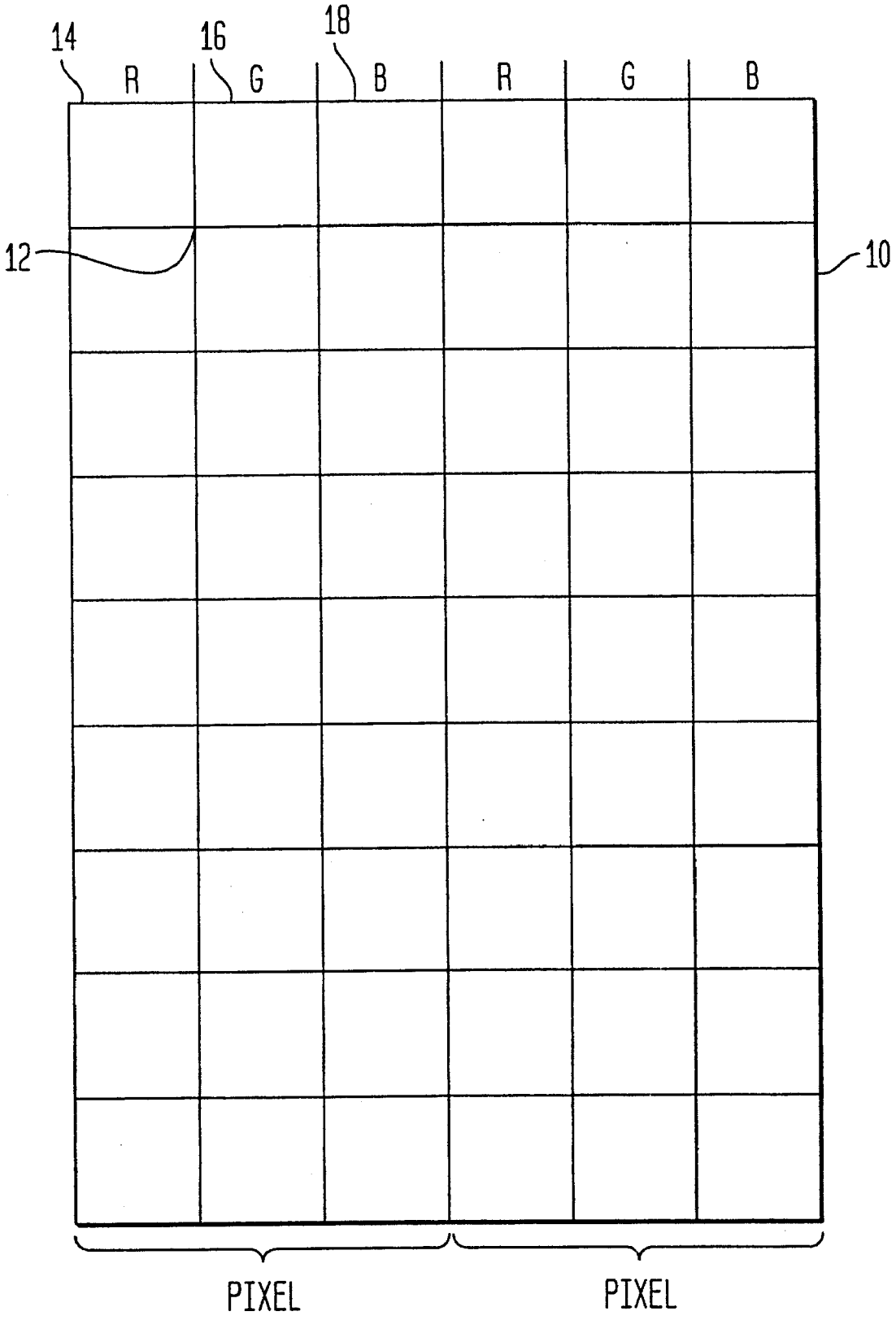
FIG. 1 is front view of a color flat panel display with lines indicating the borders of each subpixel.
Figure 2:
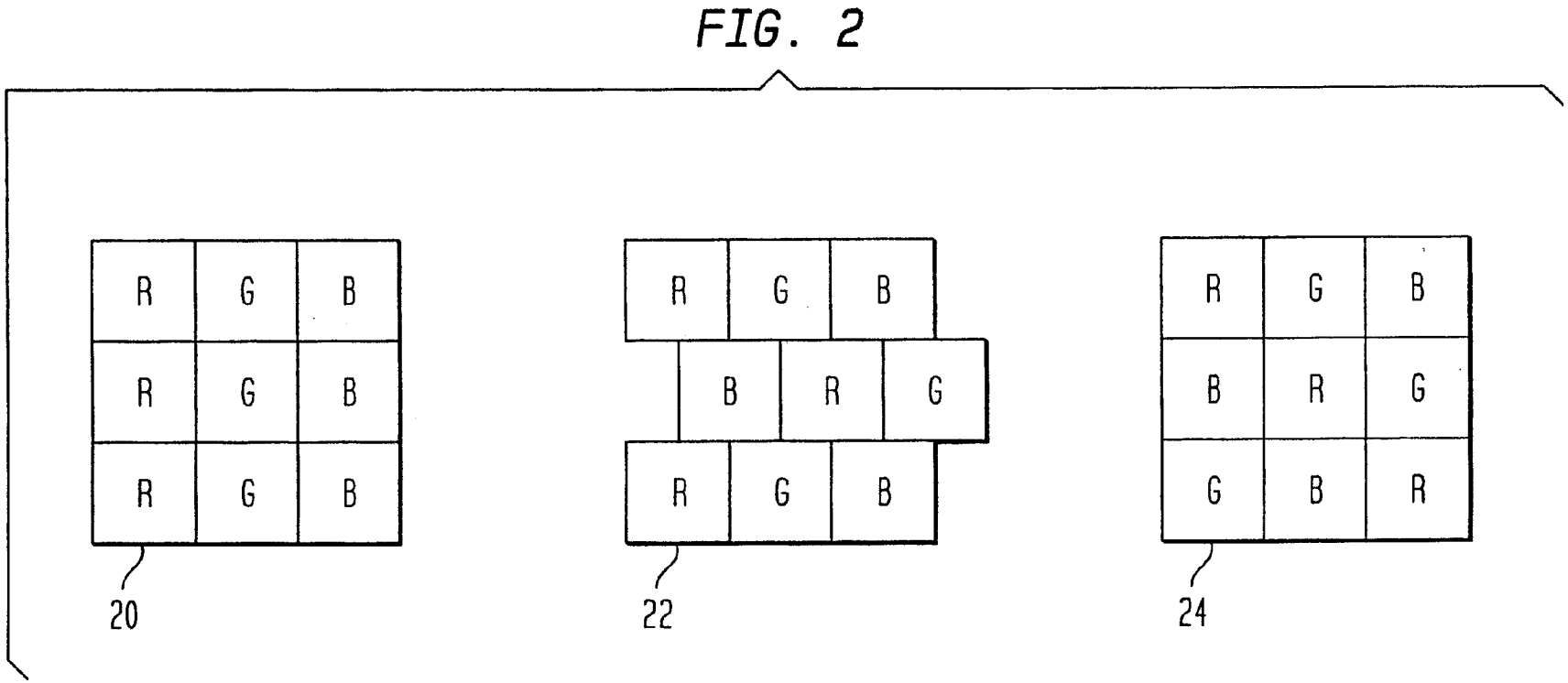
FIG. 2 is front view of a portion of three individual color flat panels, one using a stripe subpixel arrangement, one using a triad subpixel arrangement, and one using a mosaic subpixel arrangement.

FIG. 1 illustrates a color flat panel display 10 having 18 pixels 12 in a stripe arrangement. Each pixel 12 is further divided into three subpixels: a red subpixel 14 (labeled R), a green subpixel 16 (labeled G), and a blue subpixel 18 (labeled B). Most high resolution color flat panels for graphics displays use the stripe arrangement as opposed to the triad or mosaic arrangement used in lower resolution displays (such as those used in televisions). Subpixels arranged in the stripe arrangement 20, the triad arrangement 22, and the mosaic arrangement 24 are illustrated in FIG. 2.

In order to produce a point having a primary color, such as red, only a red subpixel needs to be activated. In order to produce a non-primary color (such as purple or aqua), however, two or more different color subpixels must be activated simultaneously.

Figure 3A:
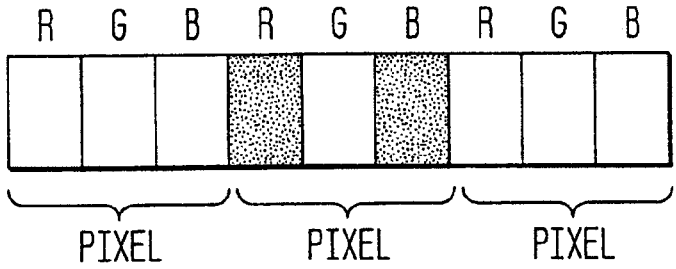
FIG. 3A is the front view of a row of nine color flat panel subpixels (three pixels) displaying a non-primary color using the traditional method.
Figure 3B:
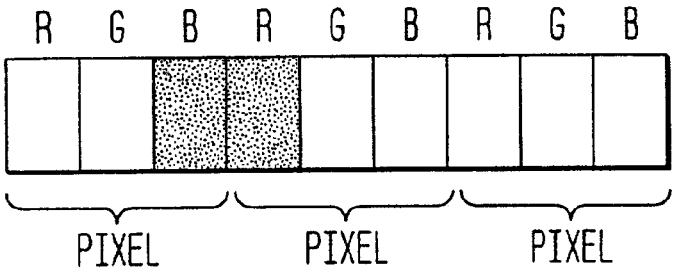
FIG. 3B is a front view of a row of nine color flat panel subpixels with a left shifted non-primary color displayed using the new method herein disclosed.
Figure 3C:
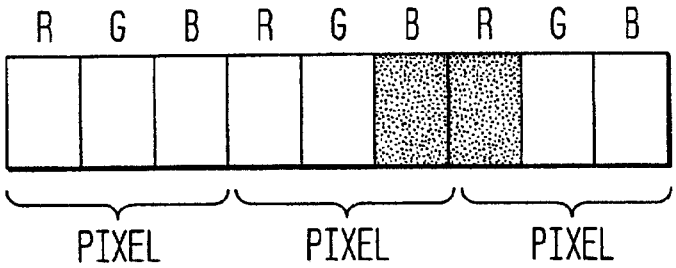
FIG. 3C is a front view of a row of nine color flat panel subpixels with a right shifted non-primary color displayed using the new method herein disclosed.

FIGS. 3A–3C illustrate a single row of three pixels, each figure having a different pair of subpixels activated simultaneously. The red subpixels are labeled R, the blue subpixels are labeled B, the green subpixels are labeled G, and groups of red, green, and blue subpixels (in that order) are labeled PIXEL. The current practice of displaying a non-primary color is to activate only subpixels within the same pixel, as illustrated in FIG. 3A. The red subpixel (R) and the blue subpixel (B) are activated in the second pixel in the row to produce a point having a non-primary color on the display. Under the current practice if a red subpixel and blue subpixel need to be activated simultaneously only the red and blue subpixels in to the first and third, the fourth and sixth column, or the seventh and ninth can be activated simultaneously. The method here disclosed involves choosing any red and blue subpixel as long as said subpixels lie in adjacent pixels. For example, the blue subpixel in the third column and the red subpixel in the fourth column, as illustrated in FIG. 3B, can be activated to display a point having a non-primary color that is shifted to the left. Furthermore, the blue subpixel in the sixth column and the red subpixel in the seventh column, as illustrated in FIG. 3C, can be activated to display a point having non-primary color that is shifted to the right. The choice between which subpixels to use should be made based on resolution concerns. If a portion of an image would be more finely represented by a pixel shifted to the left then the subpixels in the third and fourth column, as illustrated in FIG. 3B, should be chosen. If a portion of an image would be more finely represented by a pixel shifted to the right then the subpixels in the sixth and seventh column, as illustrated in FIG. 3C, should be chosen.

Figure 4:
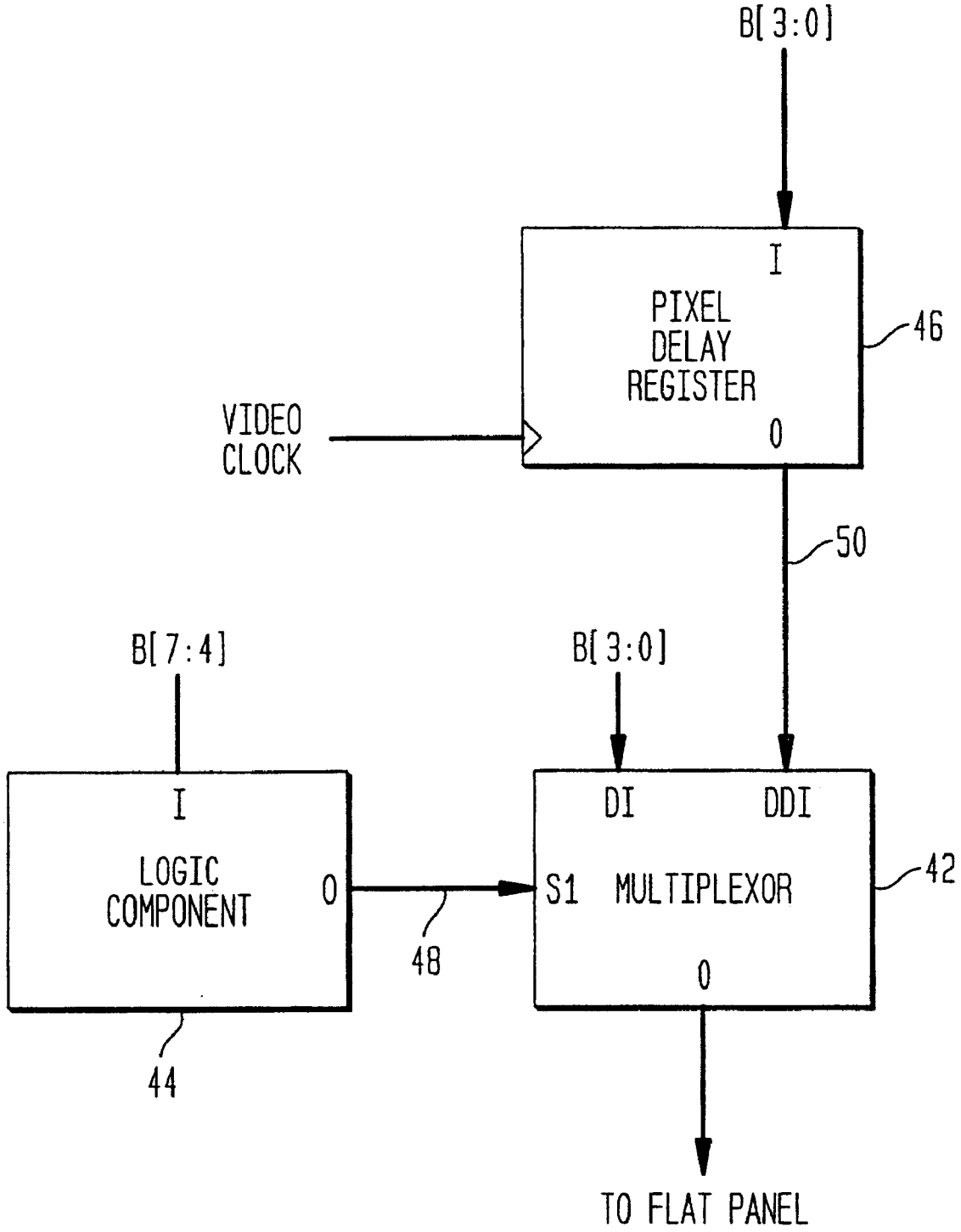
FIG. 4 illustrates a circuit capable of enhancing the horizontal resolution of a waveform displayed on a color flat panel display by a factor of three.

FIG. 4 illustrates a circuit that utilizes the above described method to specifically increase the horizontal resolution of a waveform displayed on a color flat panel display. The circuit comprises a multiplexor 42, a pixel delay register 46, and a logic component 44. The multiplexor 42 has a select input port, labeled S, a data input port, labeled DI, a delayed data input port, labeled DDI, and an output port, labeled O. The multiplexor 42 generates a TO FLAT PANEL output signal. The pixel delay register 46 has a data input port, labeled I, receives a video clock input signal, labeled Video Clock, and has an output port, labeled O. The data input port, DI, of the multiplexor 42 and the data input port, I, of the pixel delay register 46 each receive the first four bits of a digital video data input signal, labeled B[3:0], generated by software for the color flat panel. The logic component 44 has an output port, labeled O, and an input port, labeled I, which receives the last four bits of the digital video data input signal, labeled B[7:4], generated by the color flat panel software. The logic component 44 and the multiplexor 42 are connected by a first input/output line 48 between the output port, O, of the logic component 44 and the select input port, S, of the multiplexor 42. The pixel delay register 46 and the multiplexor 42 are connected by a second input/output line 50 between the output port, O, of the pixel delay register 46, and the delayed data input port, DDI, of the multiplexor 42. The logic component generates a select signal which is communicated along the first input/output line 48 and is received by the select input port, S, of the multiplexor 42.

Color flat panel displays and CRT displays accept eight bit data inputs generated by the color flat panel software. All eight bits can be used to produce 256 different colors ($2^8$=256). This large number of simultaneous colors is necessary to display a complex colored picture. However, only a small number of colors are necessary for a waveform display. Color is generally used in a waveform display only to distinguish between different waveforms on a multiple waveform display. In general, only a couple of waveforms are displayed on any one display; therefore, sixteen colors (each color used for a different waveform) is more than adequate. Accordingly, the circuit, as illustrated in FIG. 4, only dedicates the first four bits ($2^4$=16)of the eight bit data input, B[3:0] (see FIG. 4), to the display unit for color choice. Use of only four bits to represent color leaves another four bits, B[7:4] (see FIG. 4), to perform the resolution enhancement. The most significant bit, bit 7, is dedicated to indicating whether the scanner is about to scan a pixel dedicated to representing the waveform. The other three bits, bits 4–6, are used for the actual resolution enhancement transformation.

Figure 5A:
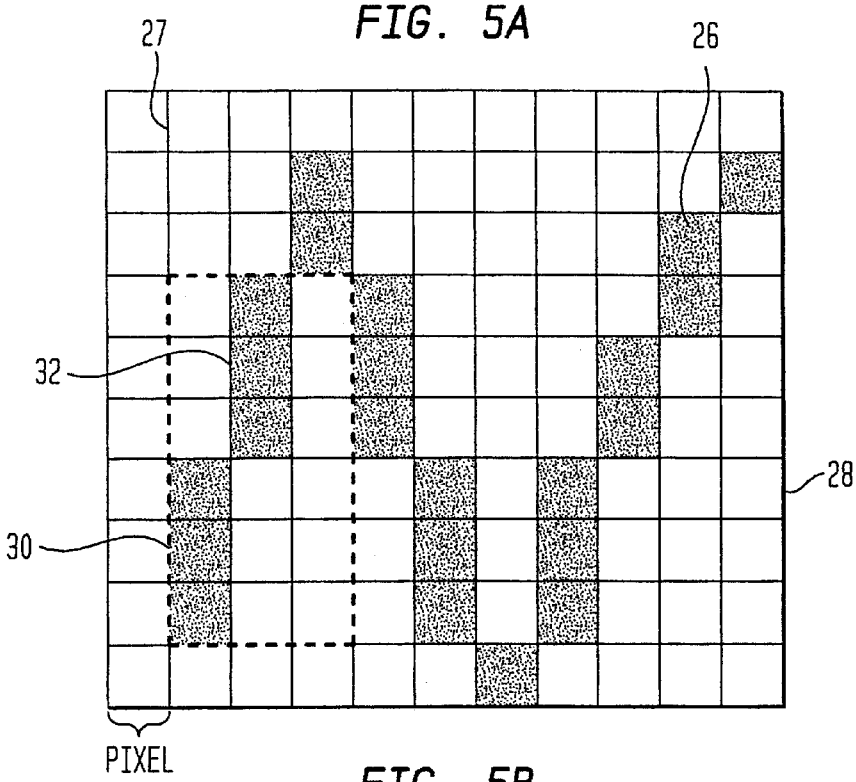
FIG. 5A is a front view of a color flat panel display with an unenhanced waveform displayed on it.
Figure 5B:
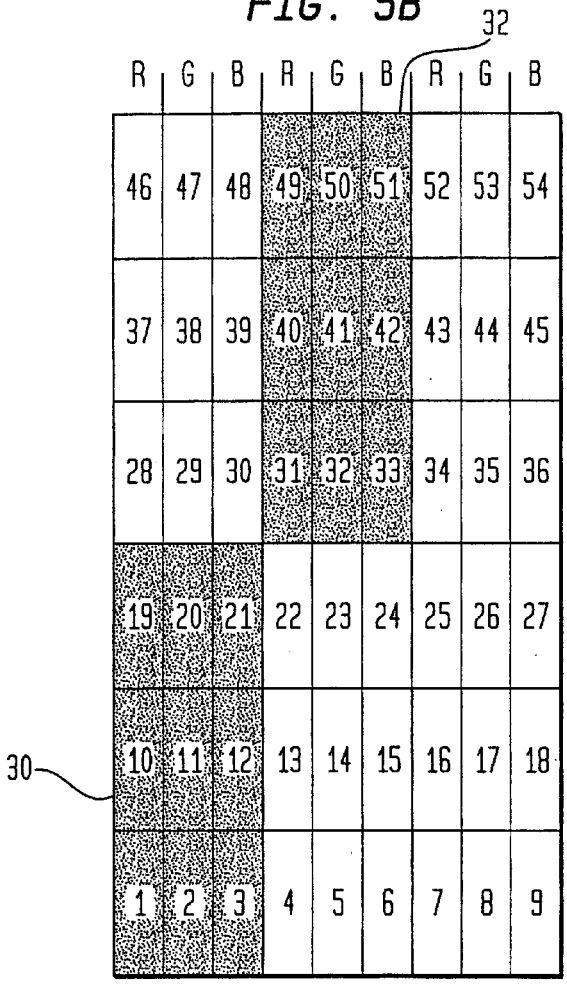
FIG. 5B is a front view of the color flat panel display of FIG. 5A focusing on the pixels circumscribed by a dotted line.
Figure 5C:
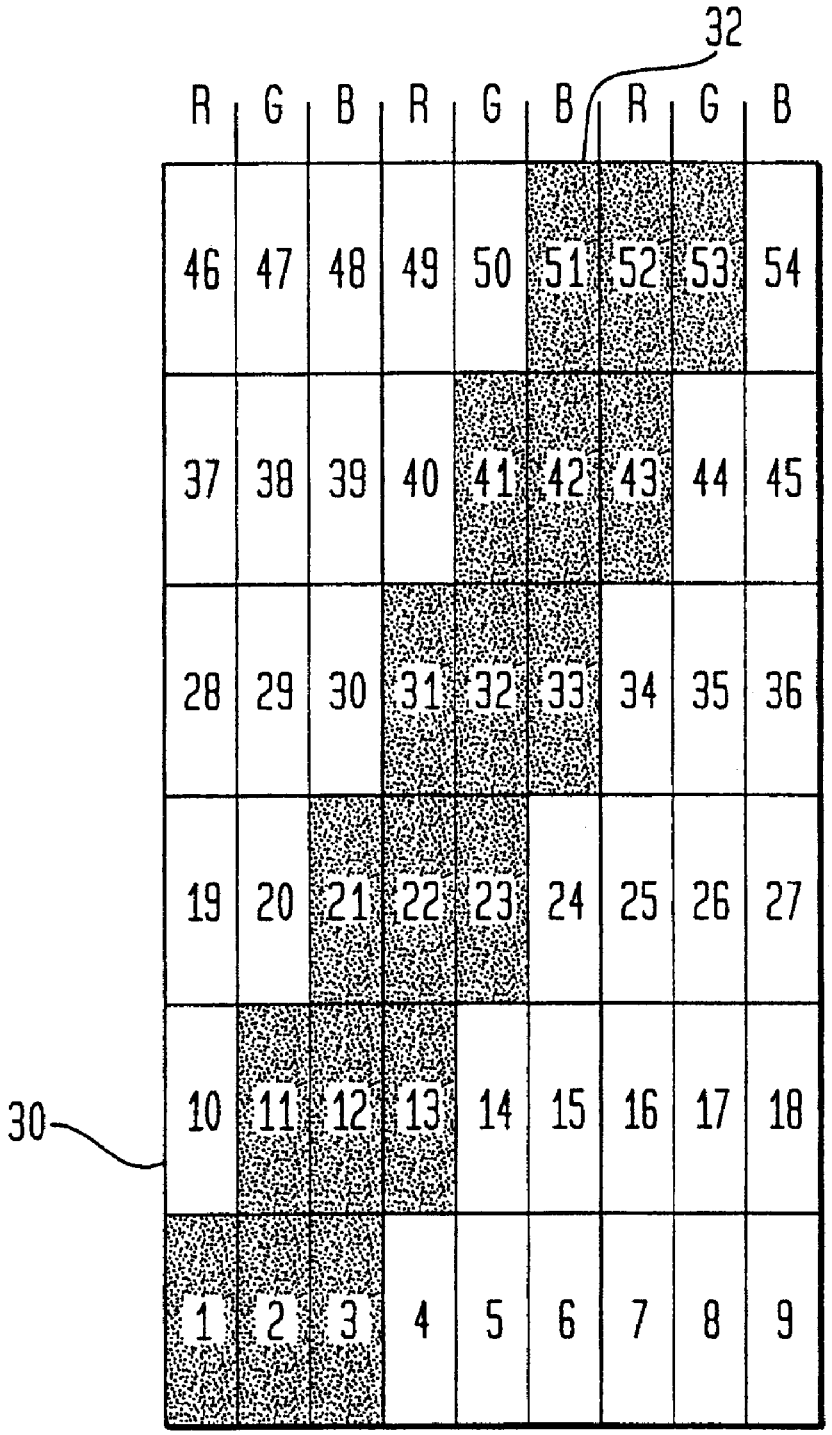
FIG. 5C is a front view of the pixels focused on in FIG. 5B after the horizontal resolution has been enhanced.

FIG. 5A illustrates a waveform 26 displayed on a color flat panel display 28. Vertical and horizontal lines 27, drawn for illustration purposes only, indicate the outlines of each pixel. FIG. 5B focuses in on the portion of the color flat panel display 28 circumscribed by the dotted lines: a first block 30 of pixels, displayed in the second column of pixels, and a second block 32 of pixels, displayed in the third column of pixels. The pixels shown in FIG. 5B are divided into red, green, and blue subpixel columns (each column of subpixels is labeled R, G, or B), as are all color flat panel displays incorporating a stripe subpixel arrangement. The subpixels are labeled numbers 1–54. FIG. 5C illustrates what the first block 30 of pixels and the second block 32 of pixels look like after the resolution enhancement is performed. In the first row there is no change, subpixels 1–3 remain on. In the second row, subpixel 10 is turned off, subpixels 11 and 12 remain on, and subpixel 13 is turned on. In the third row, subpixels 19 and 20 are turned off, subpixel 21 remains on, and subpixels 22 and 23 are turned on. In the fourth row, subpixels 31–33 remain on. In the fifth row, subpixel 40 is turned off, subpixels 41 and 42 remain on, and subpixel 43 is turned on. In the sixth row, subpixels 49 and 50 are turned off, subpixel 51 remains on, and subpixels 52 and 53 are turned on.

The resolution enhancement involves shifting subpixels in the second row of a vertical block of pixels to the right one subpixel and shifting subpixels in the third row by two subpixels. The shifting in the second row is accomplished by delaying the display of data indicating the on/off status of subpixel 10 by the amount of time it takes the scanner to scan one full pixel or three subpixels. The shifting in the third row is accomplished by delaying the display of data used to indicate the on/off status of subpixels 19 and 20 each by the amount of time it takes the scanner to scan one full pixel or three subpixels.

As can be seen in FIG. 5C, the rearranged representation of the first block 30 (FIG. 5A) and the second block 32 (FIG. 5A) represent a diagonal line more accurately. It should be noted, however, that if the blocks were 6 pixels high, rather than 3 as illustrated in FIG. 5B, pixels in the first two rows would remain on, pixels in the third and fourth row would be shifted to the right by one subpixel, and pixels in the fifth and sixth rows would be shifted two subpixels to the right. The same shifting pattern is used for longer blocks of pixels.

The manner in which the circuit, illustrated in FIG. 4, accomplishes this resolution enhancement is best illustrated through the use of general example. Before beginning this example, however, it is important to note that a scanner in a display unit(the piece of equipment which turns each individual subpixel on and off) starts at the top of the screen and scans from the left side of the screen to the right side of the screen. The speed by which the scanner scans a row of pixels is predetermined by a user or by the designers of the display unit electronics. The circuit, illustrated in FIG. 4, rearranges the order of the digital video data input and then outputs said rearranged data such that the data relating to the on/off status of each subpixel is outputted precisely when the scanner passes over said subpixel. Therefore, it is extremely important to output data exactly when the scanner is appropriately positioned to display said data.

Consider FIG. 4 and FIG. 5B together. The multiplexor 42 is set to allow data to pass through the data input port, DI, if the select signal generated by the logic component 44, and communicated along the first input/output line 48, is set high (equivalent to generating an ON signal) and is set not to allow data to pass through the data input port, DI, if the select signal is set low (equivalent to generating an OFF signal). Note that the most significant bit, of the four bit data stream B[7:4], is used to indicate whether the data point being considered is part of the waveform and that the first three bits are used to indicate whether the subpixel, determined by the last bit to be part of the waveform, should be delayed (shifted to the right of the screen). The logic component 44 basically translates information sent by the color flat panel display software, B[7:41], into information which can be used to control the multiplexor 42.

For the purposes of this example only, the scanner will scan from right to left starting at the bottom of the screen rather than starting at the top of the screen. As the display scanner scans subpixels 1–3 the most significant bit of the four bit input data stream input to the logic component 44, B[7:43], is set high by the color flat panel software (not shown) because the data points representing the on/off status of these subpixels are part of the waveform. Furthermore, since subpixels 1–3 are in the first row the color flat panel software sets the first three bits low. The logic component 44 generates an OFF signal, and as a result, the data input signal, B[3:0], inputted in the non-delayed input port, DI, is allowed to pass through the multiplexor 42 and be displayed without a delay. Accordingly, data displayed in subpixels 1–3 is not altered. Similarly, as the scanner scans subpixels 4–9, the most significant bit of B[7:4] is set low, and the first three bits are also set low. Since the signal generated by the color flat panel software is not 1001, data inputted in the nondelayed input port, DI, of the multiplexor 42 is allowed to pass through the multiplexor 42 and be displayed without a delay.

As the scanner scans subpixels 10–12, the most significant bit of B[7:4] is set high because data points displayed in subpixels 10–12 are part of the waveform. The first three bits are set to 001 for the amount of time the scanner requires to scan one subpixel. The logic component 44 generates an ON signal, and as a result, data used to represent the on/off status of subpixel 10 is directed into the pixel,delay register 46. Next, a data point used to represent the on/off status of 10 subpixel 11 enters the circuit, i.e. said data point is presented to the input port, I, of the pixel delay register 46 and to the data input port, DI, of the multiplexor 42. The first three bits of B[7:4] are now set to 000 by the color flat panel software. The logic component generates an OFF, and as a result, data is allowed to pass through the data input port, DI, of the multiplexor 42 and is displayed without a delay. Next, data used to represent the waveform in subpixel 12 enters the circuit. The multiplexor 42 generates an OFF signal and subpixel 12 is displayed without a delay.

Next, just before the scanner scans subpixel 13 the data representing the on/off status of subpixel 10 (which is a red subpixel) exits the pixel delay register 46 after a three pixel delay and passes through the multiplexor 42 (B[7:4] is set to 1001 by the color flat panel software and therefore the multiplexor generates an ON signal) and is used to determine the on/off status of subpixel 13 (which is also a red subpixel). As a result, subpixel 13 is turned on. As the scanner passes over subpixels 14–18 the data input signal, B[7:4], is set to 0000 by the color flat panel display software and, as a result, the display of these subpixels (all of which are pff) is not delayed. The scanner has completed its sweep of the second row, and as can be seen in FIG. 5C, the pixels have shifted to the right by one subpixel as desired.

Next, the scanner begins its sweep of the third row of subpixels. Data representing the on/off status of subpixel 19 enters the circuit. The logic component 44 generates an ON signal. As a result, data representing the on/off status of subpixel 19 enters the pixel delay register 46 for a three subpixel delay. Next, data representing the on/off status of subpixel 20 enters the circuit. The logic component 44 generates an ON signal (on the second row there is a two subpixel shift). As a result, data representing the on/off status of subpixel 20 enters the pixel delay register 46 also for a three subpixel delay. Next, data representing the on/off status of subpixel 21 enters the circuit. The logic component 44 generates an OFF signal and said data is allowed to pass through the data input port, DI, of the multiplexor 42, and as a result, is displayed without a delay. Next, just before the scanner scans subpixel 22, the data representing the on/off status of subpixel 19 (a red subpixel) exits the pixel delay register 46, enters the delayed data input port of the multiplexor 42, DDI, passes through the multiplexor 42, and is used to determine the on/off status of subpixel 22 (also a red subpixel). Similarly, just before the scanner scans subpixel 23, the data representing the on/off status of subpixel 20 (a green subpixel) exits the pixel delay register, passes through the multiplexor 42, and is used to determine the on/off status of subpixel 23 (also a green subpixel). The same process repeats for the second block 32 of pixels.

Note that the logic component 44, during the scanner sweep of the first row of pixels (or the first two rows of a 6 pixel vertical block, etc.), generates a select input signal that allows data to be displayed without a delay. In the second row (or the third and fourth rows in the case of a six pixel vertical block, etc.), while the scanner is sweeping over the subpixels which would have displayed the original waveform, the logic component 44 generates a select input signal that results in a delay of the first subpixel (the red subpixel) within the original waveform. In the third row (or the fifth and sixth row of a six pixel vertical block, etc.), the logic component 44 generates a select input signal that results in a delay of the first two subpixels of the original unenhanced waveform (the red and the green subpixels).

Resolution enhancement of a color flat panel display can also be accomplished through the use of software. The goal of the software color flat panel horizontal resolution enhancement program herein disclosed is to increase the horizontal resolution of a color flat panel by a factor of three. The software accomplishes this goal by allowing for the display of color information in adjacent subpixels in the following manner:

The first step involves accepting information regarding where the display of a point should start on color flat panel display. The first subpixel in the top left hand corner of the display is numbered zero, the second subpixel to the right of the first subpixel is numbered 1, the third subpixel to the right of the second subpixel is numbered 2. Once the end of a row is reached the next number starts on the left side of the screen one row below, etc.

The second step involves accepting information regarding the on/off status of a red, green, and blue subpixel within the point to be displayed.

The third step involves determining which subpixels to use to display the point. Using the conventional method, the R, G, or B subpixels within a single pixel would always be used. If the remainder of the starting subpixel number divided by 3 is equal to zero, then the red information is to be,displayed using the starting subpixel, the green information is to be displayed using the subpixel to the right of the starting subpixel, and the blue information is to be displayed using a subpixel located two subpixels to the right of the starting subpixel. If the remainder of the starting subpixel number divided by three is equal to 1, then the green information is to be displayed using the starting subpixel, the blue information is to be displayed using the subpixel to the right of the starting subpixel, and the red information is to be displayed using the subpixel located two subpixels to the right of the starting subpixel. If the remainder of the starting subpixel number divided by three is equal to 2, then the blue information is to be displayed using the starting subpixel, the red information is to be displayed using the subpixel to the right of the starting subpixel, and the green information is to be displayed using the subpixel located two subpixels to the right of the starting subpixel.

The fourth step involves displaying the red, green, and blue information in the above determined subpixel positions. After the fourth step, the process repeats.

Figure 6:
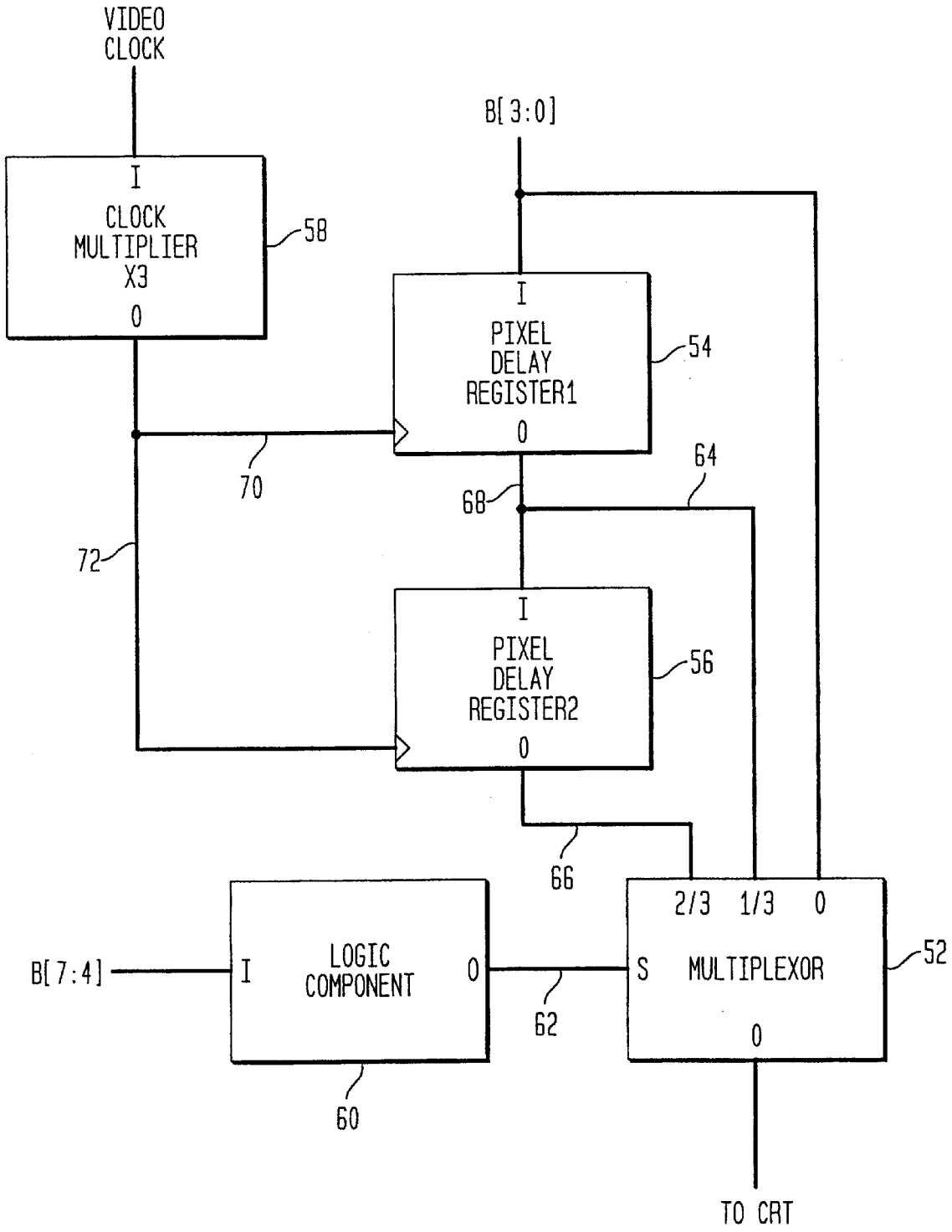
FIG. 6 illustrates a circuit capable of enhancing the resolution of a waveform displayed on a CRT display.

FIG. 6 illustrates a circuit which enhances the resolution of a CRT display. Similar to the circuit shown in FIG. 4, the circuit dedicates only the first four bits ($2^4$=16), labeled B[3:0], of the eight bit data input to the display unit for color choice. Using only four bits to represent color leaves another four bits, labeled B[7:4], to perform the resolution enhancement. The last bit of B[7:43] is dedicated to indicating whether the data point being considered is part of the waveform. The other three bits, bits 4–6, are used for the actual resolution is enhancement transformation.

The circuit comprises a clock multiplier 58, a first pixel delay register 54, a second pixel delay register 56, a logic component 60, and a multiplexor 52. The clock multiplier 58 has an output port, labeled O, and an input port, labeled I, which receives a VIDEO CLOCK signal. The multiplexor 52 has five ports: a data input port, labeled O, a 1/3 delay input port, labeled 1/3, a 2/3 delay input port, labeled 2/3, a select input port, labeled S, and an output port, labeled O. The pixel delay registers each have a clock input port and receive a clock signal, through said clock input port, that is three times as fast as the clock used for the display unit electronics. The logic component 60 has an input port, labeled I, and an output port, labeled O. The input port, I, of the logic component 60 receives as input the most significant four data bits of a 8 bit video data input signal, labeled B[7:4]. The pixel delay registers each have an input port, labeled I, and an output port, labeled O. The data input port, labeled O, of the multiplexor 52 and the input port of the first pixel delay register 54 each receive the first four bits of the video data input signal, labeled B[3:0]. The multiplexor 52 outputs from its output port, O, a TO CRT output signal, The output port, O, of the logic component 60 is connected to the select input port, S, of the multiplexor 52 by a first input/output line 62. The output port, O, of the first pixel delay register 54 is connected to the 1/3 delay input port, 1/3, of the multiplexor 52 by a second input/output line 64. The output port, labeled O, of the second pixel delay register 56 and the 2/3 delay input port, 2/3, of the multiplexor 52 are connected by a third input/output line 66. The output port, O, of the First pixel delay register 54 and the input port, I, of the second pixel delay register 56 are attached by a fourth input/output line 68. The output port, O, of the, clock multiplier 58 and the clock input port of the first pixel delay register 54 are connected by a fifth input/output line 70. The output port, O, of the clock multiplier and the clock input port of the second pixel delay register 56 are connected by a sixth input/output line 72.

Figure 7A:
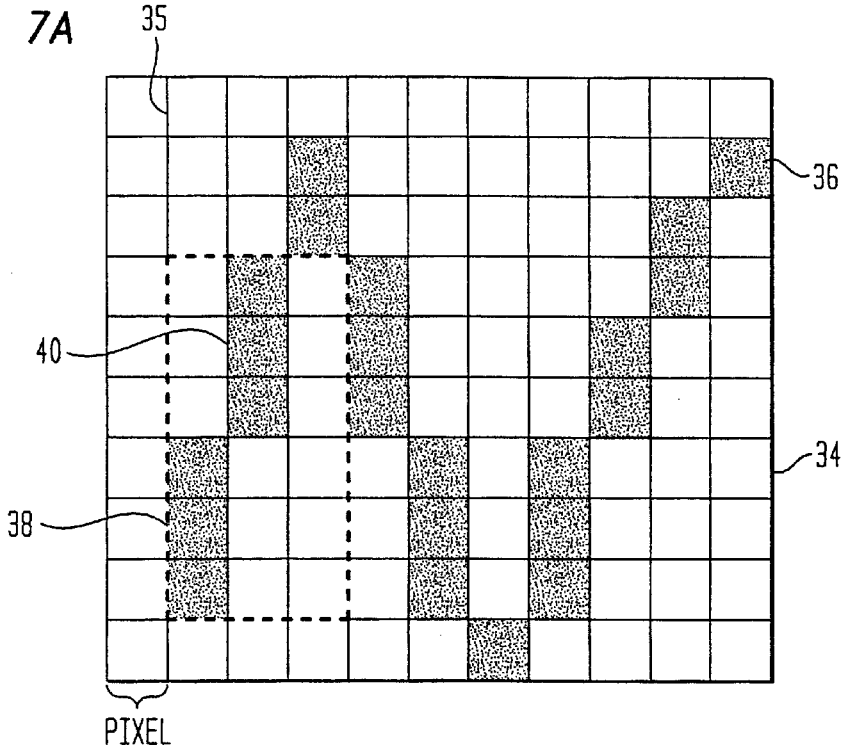
FIG. 7A is a front view of a CRT display displaying a waveform.

FIG. 7A illustrates a waveform 36 displayed on a CRT display 34. Vertical and horizontal lines 35, drawn for illustration purposes only, indicate the outlines of each subpixel.

Figure 7B:
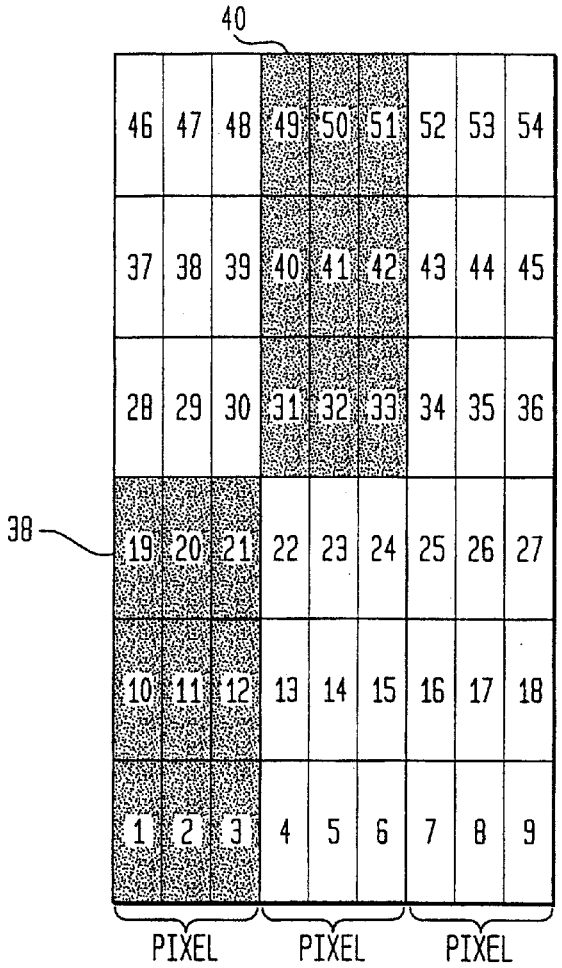
FIG. 7B a front view of the CRT display of FIG. 7A focusing on the pixels circumscribed by a dotted line.
Figure 7C:
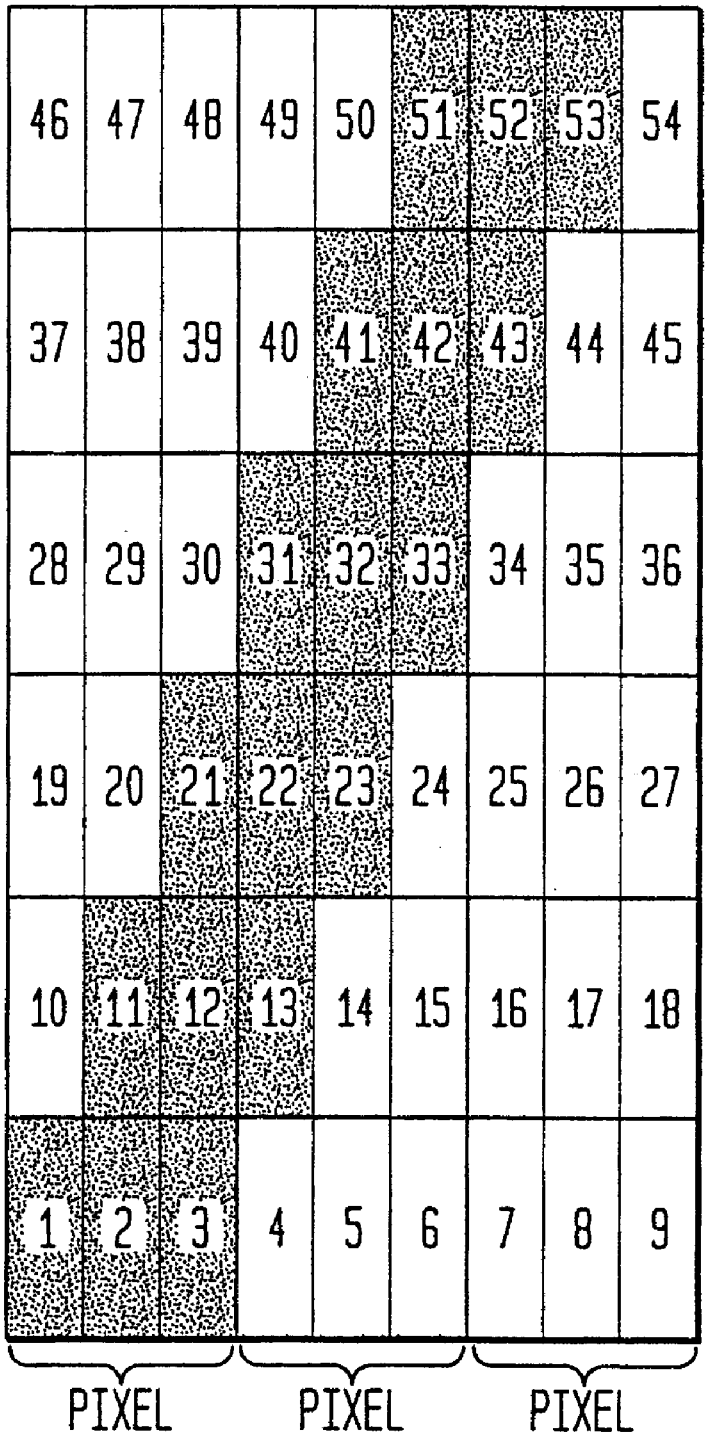
FIG. 7C is a front view of the pixels focused on in FIG. 7B after the horizontal resolution has been enhanced by the circuit shown in FIG. 6 using a clock multiplication factor of three.

FIG. 7B, similar to FIG. 5B, focuses on a first block 38 and a second block 40 which are circumscribed by a dotted line. Sets of three subpixels in the first row are labeled PIXEL. FIG. 7C illustrates the two vertical blocks after the resolution is enhanced by the circuit illustrated in FIG. 6. In the first row there is no change, subpixels 1–3 remain on. In the second row, subpixel 10 is turned off, subpixels 11 and 12 remain on, and subpixel 13 is turned on. In the third row, subpixels 19 and 20 are turned off, subpixel 21 remains on, and subpixels 22 and 23 are turned on. In the fourth row, subpixels 31–33 remain on. In the fifth row, subpixel 40 is turned off, subpixels 41 and 42 remain on, and subpixel 43 is turned on. In the sixth row, subpixels 49 and 50 are turned off, subpixel 51 remains on, and subpixel 52 is turned on.

The resolution enhancement involves shifting pixels in the second row of a vertical block of pixels to the right one third of a pixel and shifting pixels in the third row by two thirds of a pixel. This shifting is accomplished by delaying the scanner in the second row by the amount of time it takes the scanner to scan one third of a pixel and by delaying the scanner in the third row by the amount of time it takes the scanner to scan two thirds of a pixel. The circuit illustrated in FIG. 4 delayed specific subpixels in a given row to enhance the resolution of the waveform on a color flat panel display. This circuit, as illustrated in FIG. 6, on the contrary, delays the display of all of the data designated for a given row. This simplification in resolution enhancement procedure arises from the fact that a CRT display does not have different color subpixels.

It should be noted that if the blocks were 6 pixels high, rather than 3 as illustrated in FIG. 7B, pixels in the first two rows would remain in the same position, pixels in the third and fourth row would be shifted to the right by one third of a pixel, and pixels in the fifth and sixth rows would be shifted by two thirds of a pixel to the right. The same shifting pattern is used for larger blocks of pixels. As can be seen using the simple 3 pixel blocks, however, the rearranged representation of the first block 38 and the second block 40 represent a diagonal line more accurately.

The use of a general example, once again, will help clarify the workings of the circuit illustrated in FIG. 6. Consider FIG. 6 as well as the pixels focused on in FIG. 7B. The multiplexor 52 is set to allow data to pass through the data input port, labeled O, if the select input port receives from the logic component 60 any signal other than the following two signals: bit 4=1, bit 3=0, bit 2=0, and bit 1=1 (this binary number, 1001, is equivalent to the number 9) or bit 4=1, bit 3=0, bit 2=1, and bit 1=0 (this binary number, 1010, is equivalent to the number 10). If the select input port receives a signal containing 1001 from the logic component 60, the multiplexor 52 will allow data received by the 1/3 delayed data input port, labeled 1/3, to pass through the multiplexor 52. If the select input port receives a signal containing 1010 from the logic component 60, the multiplexor 52 will allow data received by the 2/3 delayed data input port to pass through the multiplexor 52. Note that the multiplexor 52 (in conjunction with the logic component 60) can be set using different numbers to trigger port choice. The choice of the number nine, 1001, and ten, 1010, is arbitrary. For simplicity, the logic component 60, in this example, passes through unaltered signal B[7:4], which is generated by the CRT software (not shown). In other situations, however, the multiplexor 52 may not understand B[7:41] to indicate a port choice and therefore the logic component 60 may be needed to translate the signal for the multiplexor 52.

Just before the display scanner scans pixel 1 the four bit select signal (equivalent to B[7:4]) generated by the logic component 60 is set to 0000 (or any other number as long as the four bit number does not equal 9 or 10) by the logic component 60 because the pixels are in the first row. As a result, data inputted in the data input port, 0, is allowed to pass through the multiplexor 52 and be displayed without a delay. Accordingly, data displayed in pixels 1–9 is not altered.

Just before the scanner scans pixel 10, the four bit select signal generated by the logic component 60 is set to 1001. As a result, data used to represent the on/off status of pixels 10–18 (in the unenhanced waveform), one by one, enter the first pixel delay register 54, and exit it to be displayed after a one third pixel delay. Data used to represent the on/off status of pixels 10–18 are displayed pixels 11–18. As a result of this one third of a pixel delay, which each data point undergoes, the display of all pixels that are turned on in the second row is shifted to the right by one third of a pixel.

Next, just before the scanner scans pixel 19 the select input port, S, of the multiplexor 52 receives a signal of 1010 from the logic component 60. As a result, data used to represent the on/off status of pixels 19–27 (in the unenhanced waveform), one by one, enter the first pixel delay register 54 for a one third of a pixel time delay and then enter the second pixel delay register 56 for another one third of a pixel time delay and then exit the second pixel delay register 56 and pass through the multiplexor 52 to be displayed. Data used to represent the on off status of pixels 19–27 (in the unenhanced waveform) are displayed pixels 21–27. As a result of this two thirds of a pixel delay, which each data point in the third row undergoes, the display of all pixels that are turned on in the second row is shifted to the right by two thirds of a pixel.

Note that the logic component 60, during the scanner sweep of the first row of pixels (or the first two rows of a 6 pixel vertical block, etc.), generates a select input signal that allows data to be displayed without a delay. During the scanner's sweep of the second row (or the third and fourth rows in the case of a six pixel vertical block, etc.) the logic component 60 generates a select input signal that directs all data through a one third of a pixel time delay. During the scanners sweep of the third row (or the fifth and sixth row of a six pixel vertical block, etc.), the logic component 60 generates a select input signal that directs all data through a two thirds of a pixel time delay.

Note that the clock multiplier 58 can be replaced with a clock multiplier having a different multiplication factor or can be removed from the circuit entirely. A circuit with a clock multiplier having a smaller multiplication factor yields less resolution enhancement. Further note that the circuits illustrated in FIGS. 4 and 6 can be combined to form a circuit capable of enhancing both a color flat panel display and a CRT display. Such a circuit overcomes a serious disadvantage inherent in a software resolution enhancement package: a software package only works to enhance the display of a color flat panel and cannot be used to enhance the resolution of a CRT.

What is claimed is:

1. A color display having increased horizontal resolution comprising a screen having a plurality of pixels comprising a plurality of color subpixels, a logic component for accepting display related information and for determining which subpixels to activate for maximum resolution, and an activation component, in communication with the logic component, for activating subpixels on the screen to display one or more points, said logic component instructing the activation component to activate subpixels that produce a point closest to a desired point for maximum resolution, said logic component not being limited to subpixels within a given pixel but rather being free to instruct activation of subpixels in adjacent pixels if the point produced by said activations produce a point closer in space to the desired position of the point for maximum resolution.

2. A method for increasing the horizontal resolution of a color display comprising a screen having a plurality of pixels comprising a plurality of color subpixels, a logic component for accepting display related information and for determining which subpixels to activate for maximum resolution, and an activation component, in communication with the logic component, for activating subpixels on the screen to display one or more points, said logic component activating color subpixels in adjacent pixels to display a point having a non-primary color when necessary for enhancement of resolution of the display, said method involving the activation of different color subpixels in adjacent pixels to display a point having a non-primary color and comprising the steps of:

accepting display related information;

determining which subpixels to activate for maximum resolution, said subpixels being located in one or more different pixels; and activating subpixels on the screen to display one or more points.

* * * * *